US005719491A

United States Patent [19]

Kolanko et al.

[11] Patent Number: 5,719,491

[45] Date of Patent: Feb. 17, 1998

[54] OUTPUT DRIVER FOR HIGH-SPEED DEVICE

[75] Inventors: Frank J. Kolanko, Greenville; Robert M. Lanoue, Greenwich, both of R.I.

[73] Assignee: Cherry Semiconductor Corporation, East Greenwich, R.I.

[21] Appl. No.: 758,999

[22] Filed: Dec. 2, 1996

[51] Int. Cl.[6] ..... G05F 5/00

[52] U.S. Cl. ..... 323/303; 323/273; 323/282; 327/541

[58] Field of Search ..... 323/273, 274, 323/275, 282, 284, 285, 299, 303, 351; 327/530, 535, 540, 541

[56] References Cited

U.S. PATENT DOCUMENTS 5,012,381 4/1991 Elliott et al. ..... 323/351 X 5,124,616 6/1992 Wrzesinski ..... 323/284

5,479,093 12/1995 Jeon ..... 323/273 X 5,552,747 9/1996 Tomasini et al. ..... 327/541 X

*Primary Examiner*—Peter S. Wong

*Assistant Examiner*—Y. J. Han

*Attorney, Agent, or Firm*—Bromberg & Sunstein LLP

[57] ABSTRACT

An output driver for providing a gate voltage to an external positive-channel field-effect transistor (PFET) device. A capacitor accumulates charge which, upon switching by an input switching signal, is applied, in addition to the supply voltage, to the base of a drive circuit NPN transistor to rapidly pull the PFET gate voltage, derived at the emitter of the drive circuit NPN transistor, up to the supply voltage. An active voltage limiter, coupled in parallel with the drive circuit, limits excursion of the gate voltage with respect to the supply voltage.

14 Claims, 5 Drawing Sheets

OUTPUT DRIVER FOR HIGH-SPEED DEVICE

The present application claims priority from U.S. provisional application No. 60/008,856, filed Dec. 19, 1995, which is hereby incorporated by reference.

1. Technical Field

The present invention relates to an output driver circuit for supplying a voltage to a switching device, and, in particular, to an output driver, implemented on an integrated circuit, for supplying a gate voltage to a discrete device such as a logic-level p-channel field-effect transistor.

2. Background of the Invention

Logic-level p-channel field-effect transistors (PFETs) have the following combination of characteristics which conspire to impose unique requirements on the driving circuitry which supplies the voltage applied to their gate:

a. The source terminal of the PFET is at the voltage potential of the positive power supply. In order to turn a PFET into its "off" state, the gate must be driven above a trip point which lies within approximately 0.5 V of the voltage potential of the source. The difference between the source potential and the gate potential is referred to as "δ." Some PFETs are characterized by a value of δ smaller than the saturation voltage across a typical bipolar device, and, thus, cannot be driven using conventional IC drive circuitry.

b. In order to advantageously apply the inherent speed of discrete PFET devices, the gate must be pulled low, to turn on conduction through the device, in a period of time on the order of 200 ns, or faster. Similarly, to turn off the device, the gate must be pulled high on a comparable time scale. It is generally not a problem to turn on the device rapidly. However, the requisite switch-off speed cannot be achieved by typical integrated circuit (IC) PNP structures because of their inherently high capacitance. On the other hand, IC NPN structures, while conventionally applied in high-speed switching applications, have, hitherto, not been applicable for switching certain discrete PFETs because they are not able to pull high enough to accomplish PFET switch-off.

c. The voltage potential between the source terminal and the gate terminal of the PFET is limited to a specific value, typically on the order of 10V, which, if exceeded, results in the failure or destruction of the device. Because of this limitation, the use of PFETs is sometimes limited to lower voltages. Since, in various applications, the supply voltages typically exceed the breakdown source-gate voltage of the PFET, measures am required to ensure protection of the PFET device.

Referring to FIG. 1A, a typical prior art output driver is indicated generally by reference character 10. In cases where it is necessary to pull the succeeding device terminal up to the rail voltage Vs, a PNP transistor Qp is typically employed. When transistor Qp is switched into saturation, the voltage applied to gate output 12 differs from Vs by only a saturation voltage, due to the finite junction resistance. PNP structures exhibit relatively high capacitances, however, and, as such, are slow to switch. Consequently, integrated circuits for high speed switching have typically used NPN structures, as shown in FIG. 1B, on their output. Referring to FIG. 1B, a typical prior art NPN output driver is indicated generally by reference character 14. Here, an NPN transistor Qn is employed. The voltage applied to gate output 12 is lower than Vs by greater than a PN junction voltage, and, as such, is unable to pull high enough to turn off certain discrete devices such as logic level PFETs.

Additionally, a circuit designed to drive PFETs must ensure that the voltage between the gate and source never exceed a certain level. For some applications, however, such as automotive electronics, higher supply voltages are available and a circuit enabling PFETs to be used at the higher voltages is advantageous. While passive voltage limiting means include Zener avalanche diodes are known in the art, it is desirable to provide an active circuit which tracks the source voltage so that, at no time, may the gate fall below a specified margin below the source.

SUMMARY OF THE INVENTION

In accordance with one embodiment of the present invention, an output driver is provided for driving a discrete device. The output driver has a supply port for receiving a positive power supply voltage, and a drive circuit for supplying an output voltage to a gate port, the drive circuit, in turn, having an input. A voltage booster rapidly supplies a voltage at the drive circuit input, while a voltage limiter is provided for clamping said output voltage level at a specified voltage.

The output driver described herein advantageously provides the capability to drive a device having a high input capacitance and tight switching tolerance at a high rate of speed. The circuit of the present invention further advantageously provides a limiter to prevent exceeding the maximum allowable potential between the output and the supply voltage. It is suited for use in integrated circuits and is tolerant of manufacturing variations in component values. Other objects and advantages of the invention are in part apparent and in part pointed out hereinafter.

DETAILED DESCRIPTION OF THE PREFERRED EMBODIMENTS

Figure 1A:
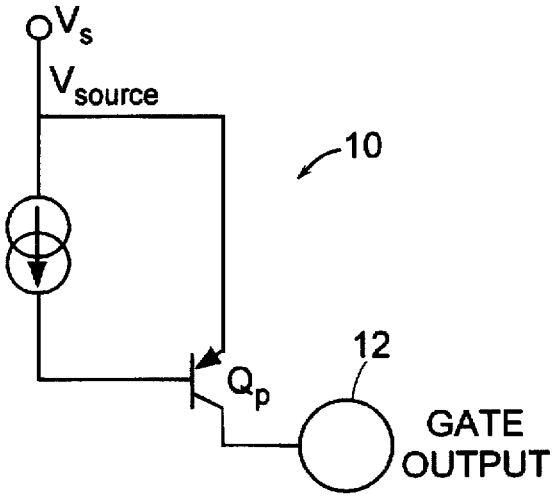
FIG. 1A PRIOR ART
FIG. 1A is a schematic diagram of a prior an output driver using a PNP bipolar device.
Figure 1B:
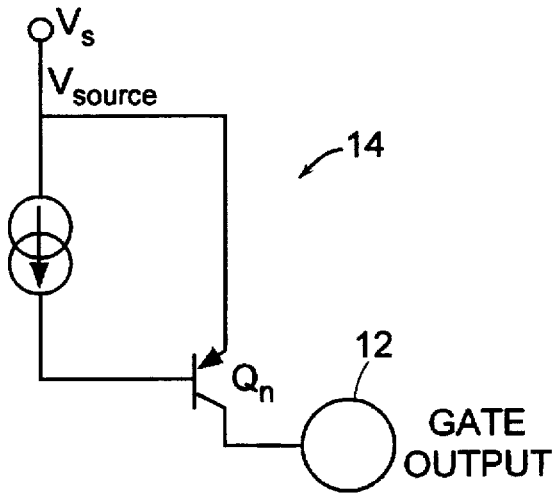
FIG. 1B PRIOR ART
FIG. 1B is a schematic diagram of a prior art output driver using an NPN bipolar device.
Figure 2:
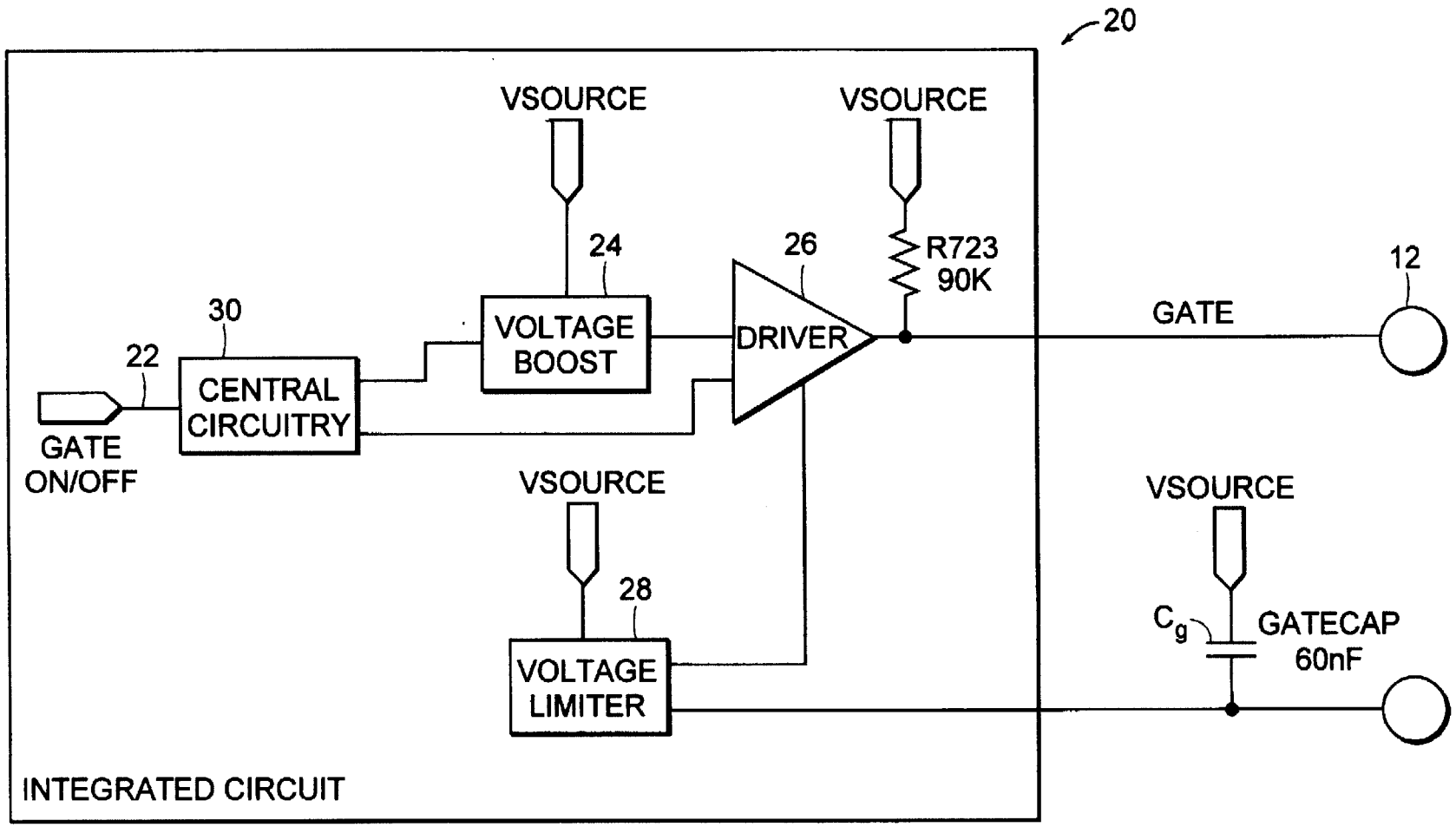
FIG. 2 is a block diagram of an output driver in accordance with an embodiment of the present invention.

Referring now to the block diagram of an embodiment of the invention depicted in FIG. 2, the output driver is indicated generally by reference character 20. In a preferred embodiment, output driver 20 is implemented as a portion or entirety of an integrated circuit (not shown). The function of output driver 20 is to supply a voltage at gate output 12 which is connected externally to a succeeding discrete device (not shown). The succeeding discrete device may be a PFET, and is referred to as such for convenience. The voltage at gate output 12 is pulled high, in order to turn off the succeeding PFET, in response to an input signal received at control input port 22. During the period when the input signal at control input port 22 is in the "gate-on" state, corresponding to a "low" state of gate output 12, voltage booster 24 develops a charge across a capacitor C700

(shown in FIG. 3) which is used, when the input signal switches to the "gate-off" state, to pull driver circuit 26 up to source voltage Vs. Control circuit 30 governs the response of driver circuit 26 to the input signal at control input port 22. After being pulled high, driver circuit 26 maintains the voltage at gate output 12 at Vs until the input signal at control input port 22 switches back to a "gate-on" state. A voltage is provided at gate output 12 via series resistor R723 in order to hold the succeeding PFET in an "off" state, in case of failure of the input signal to control input port 22. The voltage at gate output 12 is never allowed to fall below a clamp voltage provided at driver circuit 26 by voltage limiter 28. Finally, an external capacitor Cg provides an AC connection between gate output 12 and source such that the voltage at gate output 12 will not overshoot voltage limiter 28 on a transient basis.

Figure 3:
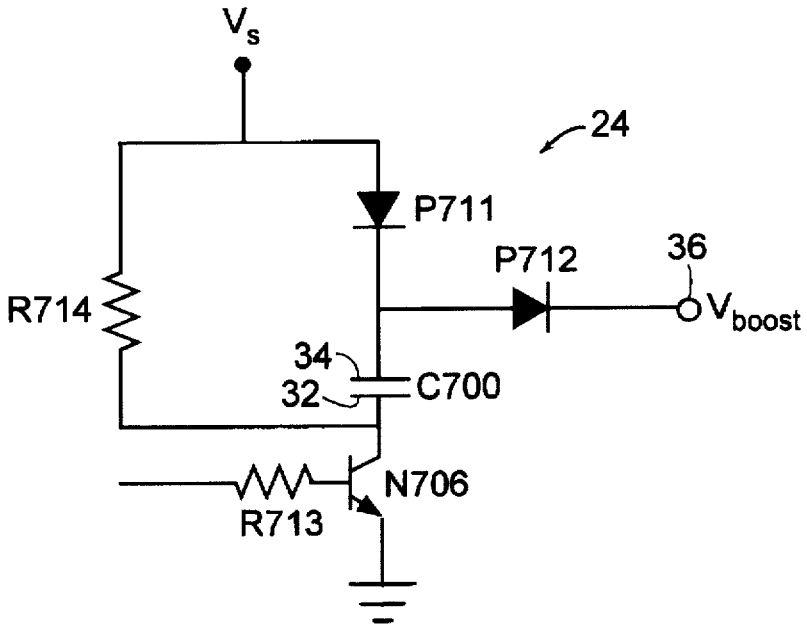
FIG. 3 is a schematic diagram of the voltage boost component of the output driver of FIG. 2.

Referring now to FIG. 3, a schematic diagram is presented of an embodiment of voltage booster 24. When the input signal is in the "gate-on" state, a current is supplied through resistor R713 to the base terminal of transistor switch N706 so that transistor switch N706 conducts. This allows current to flow from voltage supply Vs, through diode P711, with charge accumulating on the terminals of capacitor C700, until capacitor C700 is charged substantially to the potential of Vs. In the preferred embodiment of the invention, capacitor C700 is on board the integrated circuit, and has a capacitance on the order of 100 pF. When a gate "high" state is requested (i.e., the input signal is in the "gate-off" state), transistor switch N706 is switched off, decoupling capacitor C700 from ground. Since positive charge cannot flow back through diode P711, the negatively charged terminal 32 is effectively coupled to voltage supply Vs via resistor R714, while the positive charge on terminal 34 of capacitor C700 is delivered to boost input 36 through diode P712. The boost voltage Vboost appearing between boost input 36 and ground is, thus, essentially equal to twice source voltage Vs.

Figure 4:
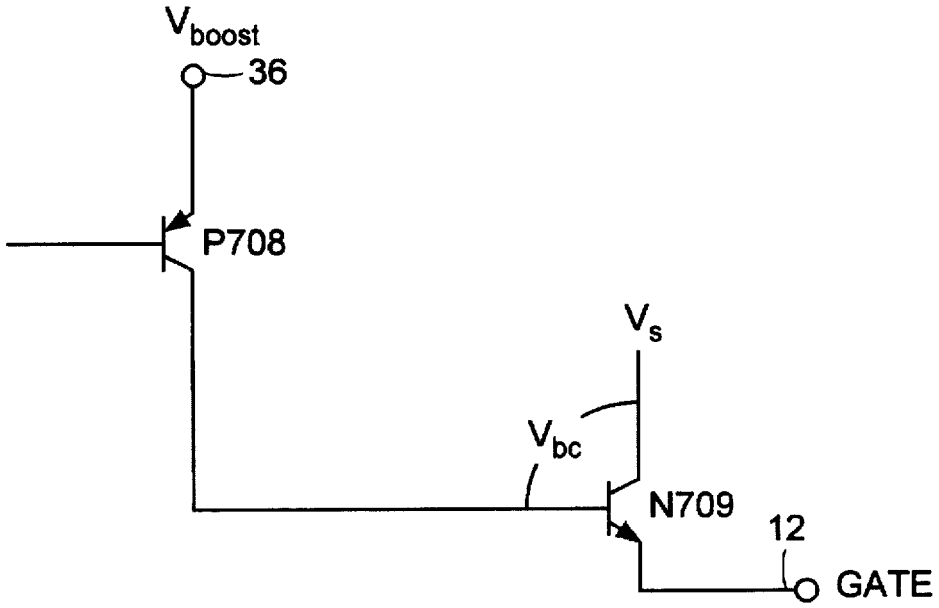
FIG. 4 is a schematic diagram of the drive circuit component of the output driver of FIG. 2.

Referring now to FIG. 4, a schematic diagram is presented of an embodiment of driver circuit 26. The gate output 12 is taken at the emitter terminal of NPN transistor N709. If transistor N709 were connected to source voltage Vs, conventionally via the base terminal of transistor N709 and the collector-emitter circuit of transistor P708, then the voltage at gate output 12 would be limited to source voltage Vs minus the base-emitter voltage Vbe(N709) minus the saturation voltage Vsat(P708). However, boost voltage Vboost, which is at a higher potential than $V_s$, is available at boost input 36, to which the emitter of transistor P708 is coupled. Thus, the voltage Vbc which can be developed across the reverse-biased base/collector junction of transistor N709 is added to the voltage Vgate appearing at gate output 12 as charge is being supplied to the PFET gate to turn off the PFET.

Figure 5:
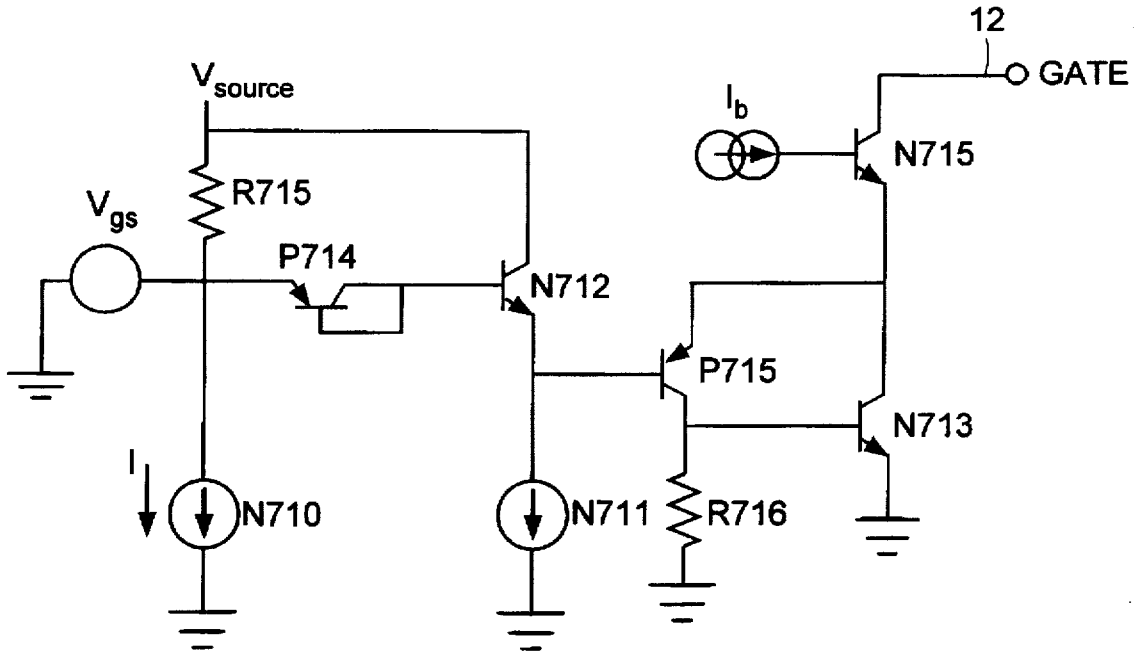
FIG. 5 is a schematic diagram of the voltage limiter component of the output driver of FIG. 2.

Voltage limiter 28, now described with reference to FIG. 5, serves to restrict the voltage between gate output 12 and the rail at source voltage Vs. Current source N710, supplies a current I which is derived, in a preferred embodiment, from an externally supplied regulated voltage (not shown). The voltage drop due to current I flowing through resistor R715 defines a voltage with respect to the rail, and, in turn, defines a voltage Vgs beneath which gate output 12 cannot fall. Gate output 12 is connected to the collector terminal of transistor N715 which operates in a saturation regime by virtue of current source $I_b$ to the base of N715. The voltage at the emitter terminal of N715 is clamped in the following manner: the base of transistor N712 is connected through diode P714 to Vgs. The emitter of N712, and the base of P715, is thus at Vgs–Vbe(P714)–Vbe(N712). The base-emitter junction of P715 is forward biased, so that the voltage at the emitter of P715 and thus at the emitter of N715 is Vbe(P715) greater than the voltage at the emitter of N712.

Figure 6:
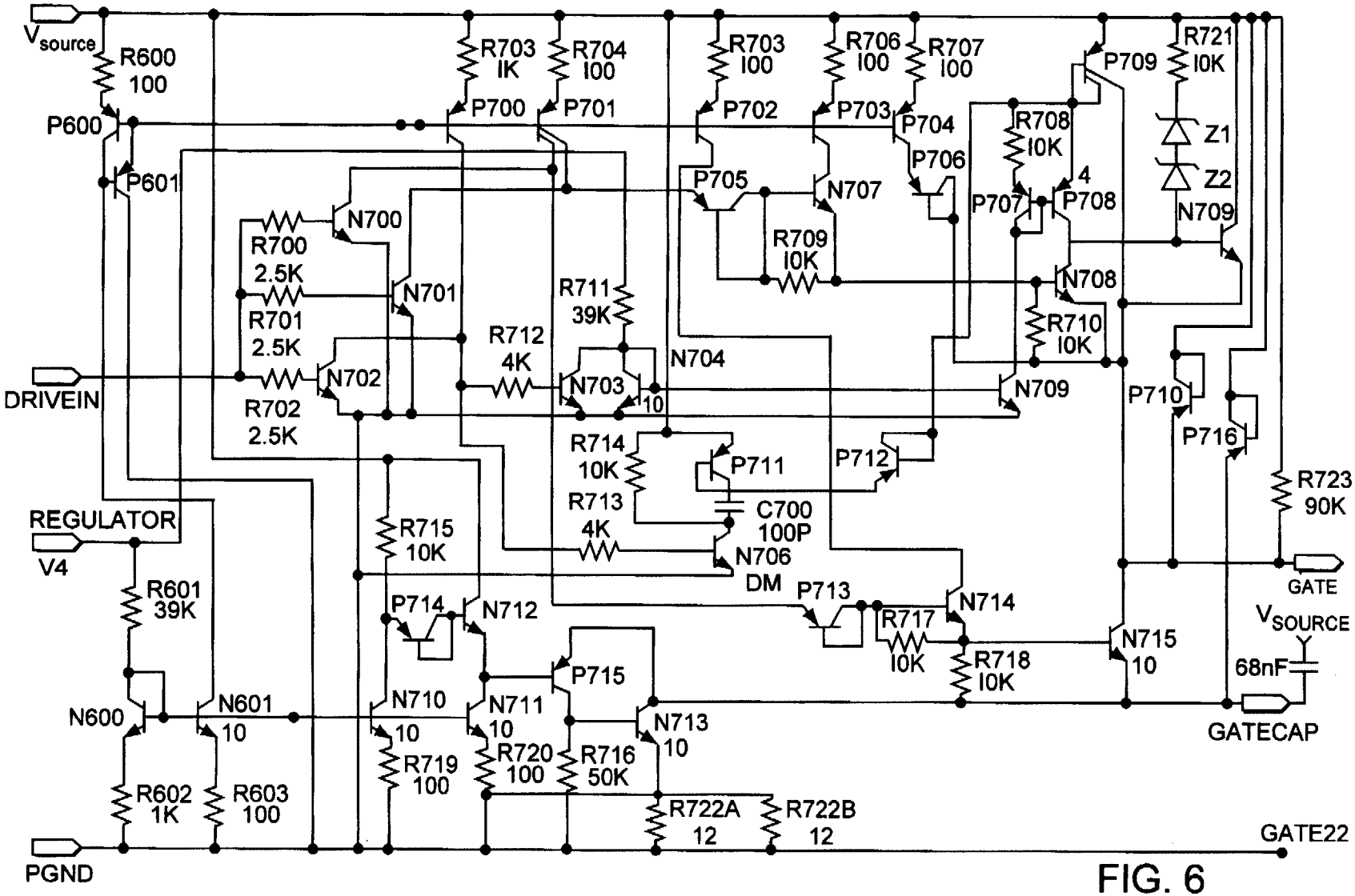
FIG. 6 is a schematic diagram of the of the output driver of FIG. 2.

Additional features of the embodiment of the invention depicted in the schematic diagram of FIG. 6 include transistor P709, which serves to hold gate output 12 at voltage Vs after it has been driven into a "high" state, and Zener diodes Z1 and Z2 which protect the external PFET from excessive gate/source voltage in the event of failure of voltage limiter 28.

The described embodiments of the inventions are intended to be merely exemplary and numerous variations and modifications will be apparent to those skilled in the art. All such variations and modifications are intended to be within the scope of the present invention as defined in the appended claims.

We claim:

1. An output driver comprising:

a supply port for receiving a positive power supply voltage;

a drive circuit having a supply input coupled to said supply port, a control input and a boost input, said drive circuit being adapted to provide an output voltage to an output port in response to a control signal;

a voltage booster adapted to provide a voltage in excess of the power supply voltage to the boost input of said drive circuit in response to the control signal; and a voltage limiter defining a voltage drop limit between the positive power supply voltage and the output port such that a voltage drop between the positive power supply voltage and the output port does not exceed the voltage drop limit.

2. The output driver as set forth in claim 1 wherein said voltage booster comprises:

a capacitor having positive terminal coupled to the boost input of said drive circuit and a negative terminal coupled to said supply port;

a diode coupled between the supply port and the positive capacitor terminal for allowing positive charge to accumulate at the positive capacitor terminal; and a transistor switch having a control input, the transistor switch being coupled between the negative capacitor terminal and ground, for selectively grounding the negative capacitor terminal in response to the control signal.

3. The output driver as set forth in claim 2 wherein said voltage booster further comprises:

a resistor coupled between the supply port and the negative capacitor terminal; and a diode having a cathode coupled to the positive capacitor terminal and an anode coupled to the boost input of said drive circuit.

4. The output driver as set forth in claim 1 wherein said drive circuit comprises:

an NPN transistor having an emitter coupled to the output port, a collector coupled to said supply port, and a base; and a PNP transistor having an emitter coupled to the boost input of the drive circuit, a base coupled to the control input and a collector coupled to the base of said NPN transistor.

5. The output driver as set forth in claim 1 wherein said voltage limiter comprises:

an NPN transistor operated in a saturation regime having a collector coupled to the output port and an emitter;

a current source;

a resistor coupled between said supply port and said current source to provide a predetermined voltage drop across said resistor; and a series of base emitter circuits between said resistor and the emitter of said NPN transistor to maintain the emitter of the NPN transistor at a specified clamp voltage.

6. The output driver as set forth in claim 5 wherein said series of base emitter circuits comprises a PNP transistor having an emitter coupled to the emitter of said NPN transistor and a base, a second NPN transistor having an emitter coupled to the base of said PNP transistor and a base, and a diode coupled between said resistor and the base of said second NPN transistor.

7. An output driver according to claim 1, further comprising a capacitor coupled between the gate output port and the supply port for receiving the power supply voltage.

8. An output driver comprising:

a supply port for receiving a positive power supply voltage;

a drive circuit including an NPN transistor having a collector coupled to said supply port, a base terminal and an emitter coupled to an output port so as to provide an output voltage at the output port in response to a control signal; and a voltage booster connected to supply a voltage in excess of the positive power supply voltage at the base of said NPN transistor in response to the control signal.

9. The output driver as set forth in claim 8 wherein said voltage booster comprises:

a capacitor having positive terminal coupled to the boost input of said drive circuit and a negative terminal coupled to said supply port;

a diode coupled between the supply port and the positive capacitor terminal for allowing positive charge to accumulate at the positive capacitor terminal; and a transistor switch having a control input, the transistor switch being coupled between the negative capacitor terminal and ground, for selectively grounding the negative capacitor terminal in response to the control signal.

10. The output driver as set forth in claim 9 wherein said voltage booster further comprises:

a resistor coupled between the supply port and the negative capacitor terminal; and a diode having a cathode coupled to the positive capacitor terminal and an anode coupled to the boost input of said drive circuit.

11. The output driver as set forth in claim 8 wherein said drive circuit comprises:

an NPN transistor having an emitter coupled to the output port, a collector coupled to said supply port, and a base; and a PNP transistor having an emitter coupled to the boost input of the drive circuit, a base coupled to the control input and a collector coupled to the base of said NPN transistor.

12. The output driver as set forth in claim 8 wherein said voltage limiter comprises:

an NPN transistor operated in a saturation regime having a collector coupled to the output port and an emitter;

a current source;

a resistor coupled between said supply port and said current source to provide a predetermined voltage drop across said resistor; and a series of base emitter circuits between said resistor and the emitter of said NPN transistor to maintain the emitter of the NPN transistor at a specified clamp voltage.

13. The output driver as set forth in claim 12 wherein said series of base emitter circuits comprises a PNP transistor having an emitter coupled to the emitter of said NPN transistor and a base, a second NPN transistor having an emitter coupled to the base of said PNP transistor and a base, and a diode coupled between said resistor and the base of said second NPN transistor.

14. An output driver according to claim 8, further comprising a capacitor coupled between the gate output port and the supply port for receiving the power supply voltage.

* * * * *